United States Patent [19]

Thunes

[11] 4,134,702

[45] Jan. 16, 1979

[54] ARRANGEMENT OF PLATFORM DECK FOR OIL RIGS OR THE LIKE

[75] Inventor: Odd Thunes, Tårnåsen, Norway

[73] Assignee: A/S Akers Mek. Verksted, Oslo, Norway

[21] Appl. No.: 802,454

[22] Filed: Jun. 1, 1977

[30] Foreign Application Priority Data

Jun. 4, 1976 [NO] Norway ..... 761897

[51] Int. Cl.[2] ..... E02B 17/00

[52] U.S. Cl. ..... 405/195; 405/201; 405/204; 52/79.1; 52/403

[58] Field of Search ..... 61/86, 87, 88, 89, 90, 61/96, 102; 52/79.1, 79.3, 79.9, 403, 167

[56] References Cited

U.S. PATENT DOCUMENTS

| | | | |
|---|---|---|---|
| 3,001,594 | 9/1961 | Suderow | 61/93 X |
| 3,283,515 | 11/1966 | Pottorf | 61/102 |

FOREIGN PATENT DOCUMENTS

| | | | |
|---|---|---|---|
| 1459949 | 1/1970 | Fed. Rep. of Germany | 52/167 |
| 1306715 | 9/1962 | France | 61/86 |

*Primary Examiner*—Jacob Shapiro
*Attorney, Agent, or Firm*—Watson, Cole, Grindle & Watson

[57] ABSTRACT

An upper deck structure which contains the equipment necessary for operation of an oil rig is positioned on top of the main deck of the rig, the main deck being supported by vertical pilings or columns. The upper deck is not rigidly connected to the main deck but is held in place by frictional engagement therebetween. Such engagement can be enhanced by the placement of a rubber layer between the two decks. The oil rig is consequently made much lighter in weight and is easier to put together.

7 Claims, 1 Drawing Figure

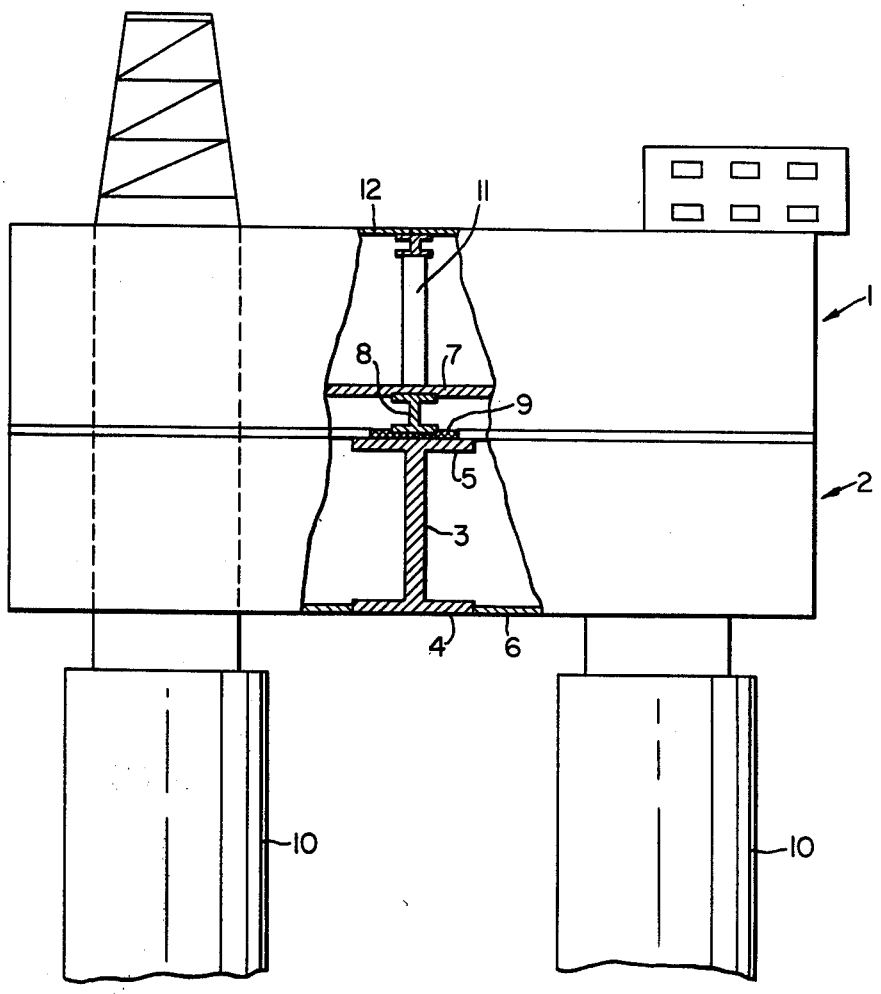
12
11
1
8
7
9
5
2
3
4
6
10
10

ARRANGEMENT OF PLATFORM DECK FOR OIL RIGS OR THE LIKE

BACKGROUND OF THE INVENTION

1. Field of the Invention

The invention relates to an arrangement of a platform deck for oil rigs or the like, which rigs normally include vertical pilings, columns or other vertical supporting structures, together with a load-bearing structure which constitutes the main deck of the rig.

2. Description of the Prior Art

It has previously been usual that on the load-bearing structure or main deck of oil rigs so-called modules are mounted thereon which comprise a part of the necessary equipment for the platform. Such modules consist of a base (on which the various machines and other equipment are mounted), walls and a ceiling, such that each of the modules form enclosed box units. These modules can be very large in size, for example about 25 meters × 15 meters × 10 meters, and they can have weights of from 600 to 2000 tons. The modules are first built in work shops and are then towed on lighters to the installation site where they are lifted in place by means of large floating cranes.

The modules are dimensioned for support by the platform supporting structure, i.e., the large beams which structurally connect the supporting columns or the like. Thus the dimensions of the modules to a certain degree will be restricted by the supporting structure of the rig.

However, since such modules are often of great size and weight, they thus require extensive and costly precautions when brought in place on the main deck.

Moreover, the connection of pipes, etc., between the various modules is time consuming and complicated, especially when the pipes to be connected have different positions on the respective modules. Such connections for pipes have to be carried out in the narrow free passage between respective modules.

The object of the present invention is to provide a modification of the structural features for such oil rigs, to thereby obtain a simpler installation of the machines and equipment included therein, and at the same time achieve a very substantial saving in weight. This last mentioned feature can be of the greatest importance in the case of rigs where the equipment is entirely or partly installed onshore before towing to an offshore location. The weight of the total top structure will then be of critical significance, e.g. with respect to its stability.

SUMMARY OF THE INVENTION

According to the present invention, instead of using modules to install the necessary equipment such as machinery, etc., directly on the platform, an upper deck is arranged on the main deck, on which such upper deck equipment can be installed directly. In this way the great additional weights represented by the modules together are saved, i.e., one avoids the base as well as the frame work and casing of the machines or the like. Instead, such equipment is installed directly on the upper deck which is provided with walls and a ceiling to form a deck house.

Parts of the upper deck can be prefabricated and parts of the equipment can then be installed thereon before the deck is placed on the supporting structure. Rational production and effective reduction of the delivery time of the oil rig may thereby be obtained.

The upper deck is arranged "floating" on the supporting structure. If instead of such arrangement the necessary beams, stanchions, etc., were built on the supporting structure by use of, for instance, welding, the upper deck obtained thereby would be subjected to deformations, i.e., expansions/contractions of the structurally weak supporting beams. The upper deck and its appurtenant deck house would then necessarily have to be designed with this in mind, the result being a heavier and more complicated structure. Instead, according to the invention, it is proposed that the upper deck be arranged loosely on top of the supporting beams of the structure and laterally supported only by friction. Preferably, an intermediate layer of elastic material, for instance, rubber or neoprene, can be arranged between these two main parts. This intermediate layer has also for its object to prevent gas from flowing between the various rooms of the structure.

The importance of the very favorable and weight saving design according to the invention is emphasized by the fact that the weight of the modules usually being arranged on such platforms can amount to 30,000 tons. This includes the total weight of the base, framework and housing of the machinery, etc., when all equipment is mounted in modules. Instead of this great weight, one will, according to the invention, obtain a relatively negligible weight of the comparatively light upper deck with appurtenant deck house. These details will scarcely amount to more than 4,000–5,000 tons. This will replace module steel of the magnitude of 12,000–15,000 tons.

For a better understanding of the invention, reference is made to the attached FIGURE which shows a schematic drawing of an embodiment of the invention.

In the FIGURE the main deck is denoted 2 and the upper deck unit is denoted 1. The main deck 2 can have a height of 10 meters and consist of webs 3 (bulkheads) and flanges 5,4 at the top and bottom, respectively (I-beams). The flanges can have a width of 3–4 meters. In alignment with the lower flanges is arranged a deck flooring 6 for equipment incorporated in the main deck. The main deck 2 rests in the example shown on the top of columns 10. The upper deck 1 rests freely on the main deck 2, i.e. it "floats" thereon, there being no rigid connections or welds between the upper deck and the main deck. The deck flooring 7 of the upper deck 1 is supported by beams, e.g., such as the I-beams 8 shown in the FIGURE, which again rest on the top flanges 5 of the main deck 2. Between the lower flanges of the beams 8 and the upper flanges 5 is arranged an elastic intermediate layer 9 of for instance rubber or neoprene.

To get as much space as possible in the upper deck 1 and as few obstacles as possible for pipes, conduits, etc., stanchions 11 are arranged between the deck flooring 7 and the ceiling 12 of the upper deck 1.

The upper deck 1 can be built in parts and transferred to the building site for the main deck and then lifted in place. An upper deck arranged in this way can be completed and stand ready for being lifted in place when the equipment has been mounted in the main deck. Since the upper deck is not to be welded to the main deck, this work can be carried out relatively quickly. After the flooring of the upper deck has been brought in place, the equipment thereon is installed. Finally, stanchions or the like and a ceiling is mounted for the upper deck. This can readily be assembled in advance so that the installation time for the main deck can be reduced.

I claim:

1. A platform deck for oil rigs or the like comprising means forming a main deck, means for supporting the main deck, an upper deck flooring positioned on said main deck, walls positioned on said upper deck flooring, and a ceiling mounted on said walls so as to form, together with said upper deck flooring, an enclosed upper deck, said flooring being non-rigidly interconnected with said main deck.

2. The platform deck of claim 1 wherein machinery for operation of the oil rig or the like are installed on top of said upper deck flooring.

3. The platform deck of claim 2 wherein a layer of elastic material is placed between said main deck and said upper deck flooring.

4. The platform deck of claim 3 wherein said elastic material is rubber.

5. The platform deck of claim 3 wherein said elastic material is neoprene.

6. The platform deck of claim 1 wherein I-beams are positioned between the main deck and the upper deck flooring.

7. The platform deck of claim 6 wherein said main deck comprises a main deck floor and I-beams positioned on said main deck floor, and wherein said I-beams positioned between said main deck and said upper deck flooring are positioned to rest at one end on said I-beams of said main deck and support at their other end said upper deck flooring.

* * * * *